United States Patent [19]

Burns

[11] Patent Number: 5,020,797

[45] Date of Patent: Jun. 4, 1991

[54] METHOD AND APPARATUS FOR EXERCISING THE KNEE WHILE CORRECTING FOR TIBIAL SUBLUXATION

[76] Inventor: Clay A. Burns, 55 Washington St., #10, Medford, Mass. 02155

[21] Appl. No.: 451,370

[22] Filed: Dec. 15, 1989

[51] Int. Cl.[5] ..... A63B 21/00; A61F 5/00

[52] U.S. Cl. ..... 272/143; 272/134; 128/80 R; 128/80 F

[58] Field of Search ..... 128/80 R, 80 C, 80 F, 128/80 G, 24 R, 25 R, 25 B, 78-80; 272/116, 117, 125, 142, 143, 93, 134

[56] References Cited

U.S. PATENT DOCUMENTS 4,407,496 10/1983 Johnson ..... 272/117
4,502,681 3/1985 Blomqvist ..... 272/142
4,628,910 12/1986 Krukowski ..... 128/25 R
4,718,665 1/1988 Airy et al. ..... 272/132
4,902,009 2/1990 Jones ..... 272/134

*Primary Examiner*—Richard J. Apley
*Assistant Examiner*—Linda C. M. Dvorak

[57] ABSTRACT

An appliance for use in exercise therapy for rehabilitation of a patient's leg having a tibia which exhibits posterior subluxation, e.g., due to an injured posterior cruciate ligament of the knee, displaces the tibia in the anterior direction to correct for the tibial subluxation while, at the same time, applies a posteriorly directed force to the lower shin against which the leg is to be extended for exercise during the therapy.

11 Claims, 3 Drawing Sheets

FIG. 1
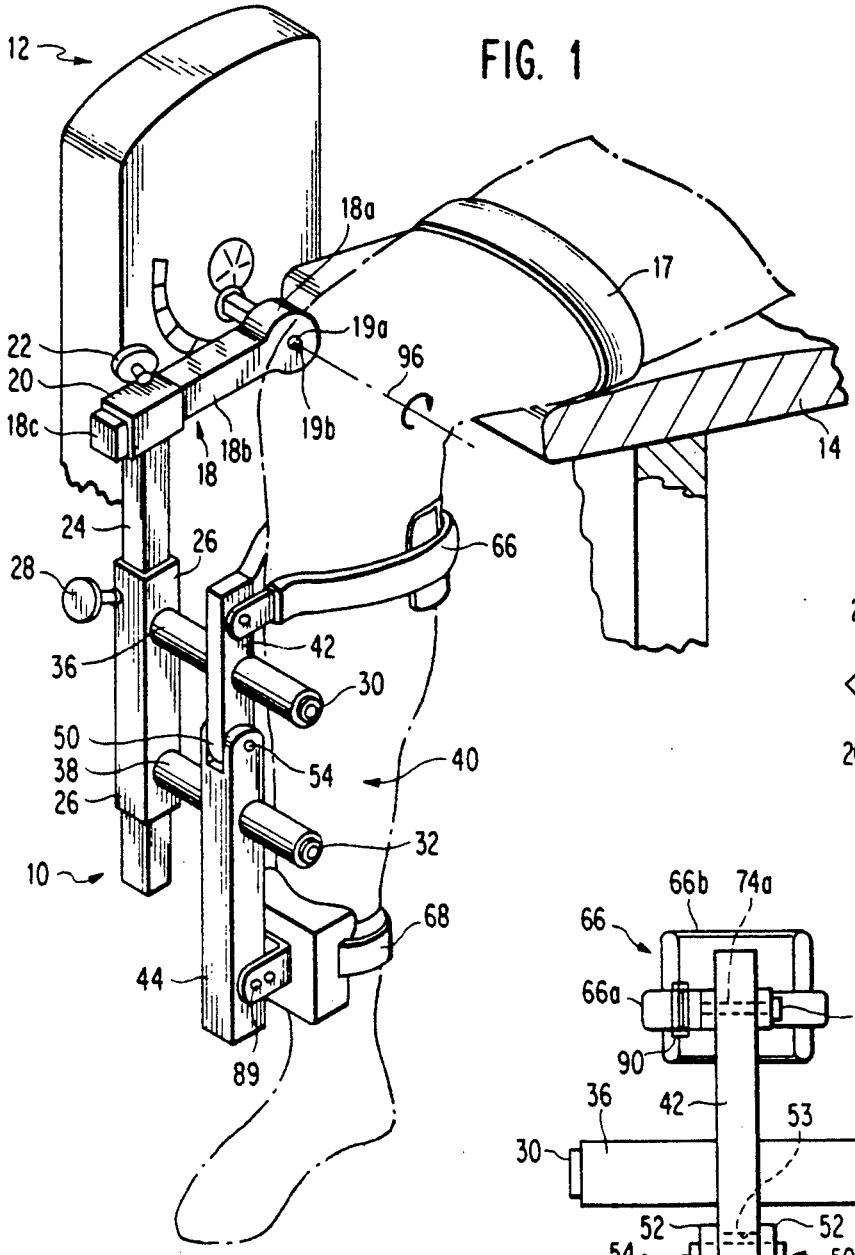
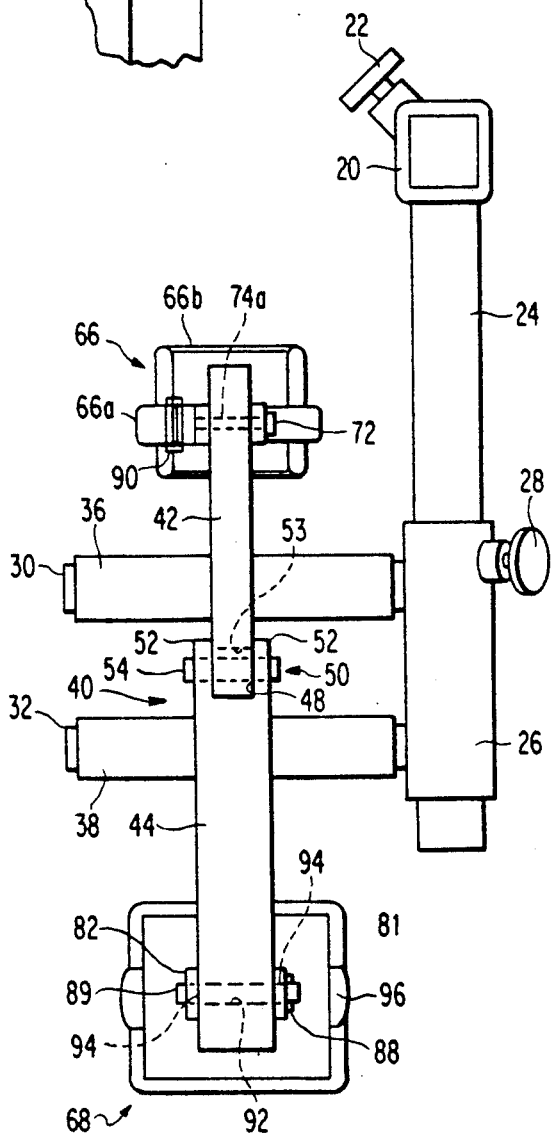
FIG. 2

METHOD AND APPARATUS FOR EXERCISING THE KNEE WHILE CORRECTING FOR TIBIAL SUBLUXATION

FIELD OF THE INVENTION

The invention relates to exercise apparatus, and more particularly to devices useful in rehabilitative exercise therapy for the knee.

BACKGROUND OF THE INVENTION

Exercise therapy is prescribed for rehabilitating patients who have suffered certain types of physical injuries. Rehabilitative exercise for injured knee ligaments, for instance, is aimed at strengthening the muscles that flex or extend the leg. These are called, respectively, flexion and extension exercises. Flexion exercises work the hamstring muscles generally located in the posterior of the upper leg. On the other hand, extension exercises work the quadracep muscles generally located in the anterior of the upper leg. By exercising the affected knee and strengthening those muscles during rehabilitation, muscle atrophy in the injured limb is reduced or prevented altogether.

Exercising the injured knee during rehabilitation, especially after surgical repair of torn ligaments, preferably is performed under controlled conditions so as not to stress excessively the injured ligaments. Excessively stressing the injured ligaments can impede the healing process or even aggravate the injury.

Various commercially-available, general-purpose resistance machines are useful in providing controlled rehabilitative exercise. Among these is the CYBEX II isokinetic dynamometer made by the Cybex division of Lumex, Inc., N.Y., N.Y. In addition, U.S. Pat. No. 2,855,199 issued Oct. 7, 1958, and entitled EXERCISE DEVICE, and U.S. Pat. No. 3,465,592 issued Sept. 9, 1969, and entitled ISOKINETIC EXERCISE PROCESS AND APPARATUS, disclose other designs for such machines.

Generally, in known exercise machines of this type, the limb to be exercised is placed against a typically padded contact element that is drivingly connected to the resistance machine. Usually the extremity of the limb, e.g., the ankle, bears against the contact element. The contact element can take the form, for example, of an appliance that is removably worn by the patient during exercise.

For leg extension exercises, a seated patient wearing such an appliance bends his knee so as to swing his ankle upwardly against a resistance applied thereto through the appliance by the exercise machine. One form of exercise machine, known as an isokinetic dynamometer, enables isokinetic exercise throughout a high percentage of the full range of motion of the limb being exercised. Such machines can be manually set at a selected angular velocity (in degrees/second). The resistance machine then resists the force executed by the user so as to maintain the selected speed.

Various specially designed appliances have been suggested to control the application of force to an injured limb during rehabilitative exercise using such exercise machines. For instance, U.S. Pat. No. 4,407,496 discloses a variation for communicating the machine-generated force to two, spaced locations on the front of the leg being exercised, supposedly for counteracting detrimental shearing forces in the knee. The spaced, communicated forces are both applied in the same direction.

In accordance with that patent, the appliance has two, spaced-apart pads which are strapped on the front of the lower leg, an upper pad positioned just below the knee cap, and a lower pad positioned on the ankle. The pads are inter-connected by an elongate member of variable length. The inter-connecting member also pivotally connects to a resistance arm of the machine. The machine-generated force is communicated through the resistance arm to the appliance, through both pads thereof, and thence to the front of the leg. During extension exercise, the forces applied to the leg by the appliance both act in the same posterior direction to resist muscular force and, as mentioned above, supposedly, to counteract shear forces on the injured knee. The patented device is suggested for use during flexion as well as extension exercises.

Another therapeutic device is proposed in U.S. Pat. No. 4,502,681 to Blomqvist for use in rehabilitation of patients having degenerated tibia-femoral joints. That device supposedly reduces pressure between the femur and tibia during quadracep training by displacing the center of rotation of the resistance arm of the exercise machine anteriorly from the center of rotation of the knee. Consequently, the resistance arm and the patients leg follow two different arcs so as to slightly pull the tibia away from the femur.

SUMMARY OF THE INVENTION

The invention resides in an exercise device or appliance useful in rehabilitative exercise therapy following an injury to the posterior cruciate ligament ("PCL") of the knee. The appliance applies, in addition to the resistive force against which the leg is exercised, a supportive force to relocate the tibia to correct for tibial subluxation during leg extension exercises.

Injuries to the PCL have been found to cause tibial subluxation. Tibial subluxation is an unwanted dislocation of the tibia from its proper location and alignment in the knee. Rehabilitative exercise performed while the tibia is subluxated can aggravate the injury and even cause serious complications, such as degenerative arthritis of that knee. By correcting for tibial subluxation, the appliance in accordance with the invention avoids such problems and permits regular exercise therapy to commence early and continue through-out rehabilitation of the knee.

In a preferred embodiment of the invention, the exercise appliance, which is worn on the lower leg, simultaneously applies a forward-directed "supportive force" at the top of the calf (i.e., at a location along the top one-third or so of the tibia) and a rearward-directed "resistive force" at the bottom of the shin (i.e., at a location along the bottom one-third or so of the tibia) through respective upper and lower pads. The posteriorly-directed resistive force oppose the motion (preferably, isokinetically) of that leg during exercise. The combination of these forces, acting in opposite directions, and near opposite ends of opposite sides of the tibia during exercise, urges the tibia toward its normal, unsubluxated orientation with respect to the femur, thus correcting for tibial subluxation. To achieve this latter effect, the supportive force is proportionately related (approximately, 1.5:1) to the resistive force. Both the supportive and resistive forces preferably are derived by the appliance from the force generated by the exercise machine.

The exercise device in accordance with the invention is straightforward and easy to use. Furthermore, it is safe to use, both in that it does not impose danger of injury to the already injured joint or to other parts of the body when correctly adjusted to the patient's leg and correctly used, and in that it presents no risk of injury to other people in the vicinity of the device during exercise.

Aspects of the invention not only find utility in rehabilitative exercise therapy, but also in physical conditioning and testing and evaluation, as well as in bracing and supporting an injured joint during normal daily activities. Furthermore, the preferred embodiment of the invention can be adapted advantageously for use in the rehabilitation of other major joints of the human body in addition to the knee, as well as in veterinarian applications.

BRIEF DESCRIPTION OF THE DRAWINGS

For a fuller understanding of the nature and objects of the invention, reference should be had to the following detailed description, taken in connection with the accompanying drawings, in which:

FIG. 1 is an isometric view of an exercise appliance in accordance with the invention, which is connected to an exercise machine and is arranged for exercising the right leg of a patient;

FIG. 2 is a front view, partially in phantom, of the exercise appliance of FIG. 1 which is arranged, however, for exercising the left leg of a patient;

Figure 3:
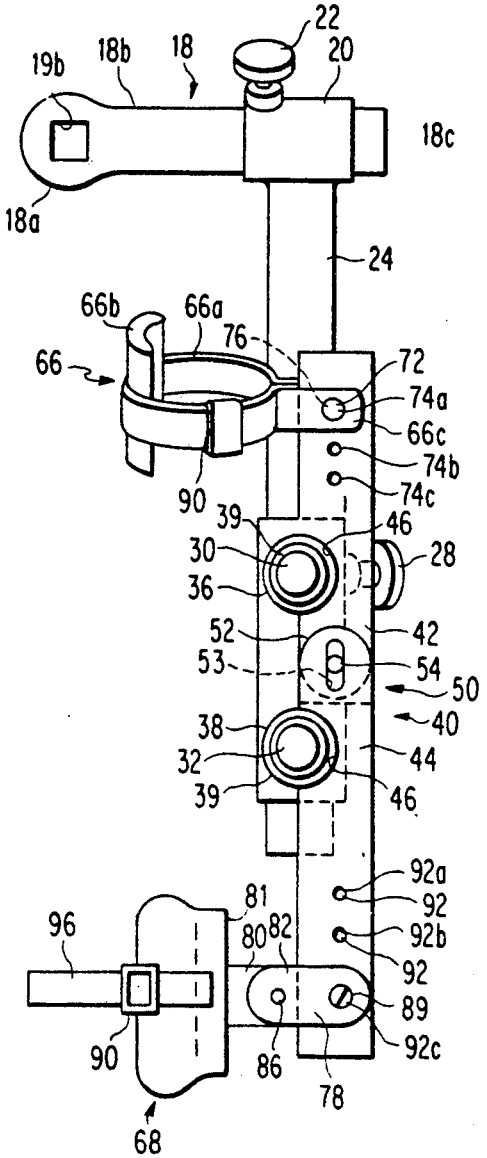
FIG. 3 is a left side view, partially cut-away, of the exercise appliance of FIG. 2.

DESCRIPTION OF THE PREFERRED EMBODIMENT a. Exercise Appliance for Posterior Cruciate Ligament Rehabilitation

FIG. 1 depicts an exercise device or appliance in accordance with a preferred embodiment of the invention generally at 10. The exercise appliance 10 is adapted for use in performing leg extension exercises, e.g., during exercise therapy in the rehabilitation of a patient having an injured and, if performed, surgically repaired, posterior cruciate ligament with resulting tibial subluxation.

The exercise appliance 10 applies a posteriorly-directed resistive force at the extremity of the leg (e.g., at the lower shin in the vicinity of the front of the ankle) against which the leg is extended during the exercise. In addition, the appliance 10 applies an anteriorly-directed supportive force at the top of the calf during each repetition of the leg extension exercise. The combination of these forces tends to rotate the tibia toward its normal orientation, thereby correcting for the tibial subluxation during the exercise.

Preferably, both the supportive force and the resistive force are derived from the force supplied by an exercise equipment 12, to which the appliance 10 is coupled. Alternatively, a separate source (not shown) can supply the supportive force.

The exercise equipment 12 includes a seat, bench or table 14 to support the patient in a sitting or reclining position, and a force-generating machine 16. With the patient seated, the patient's leg is bent at approximately a right angle at the knee, with the lower leg directed toward the floor. A strap 17 is used to firmly hold the lower end of the upper leg, just above the knee, to the table 14. The force-generating machine 16 is of conventional design and operation. The earlier mentioned CYBEX II exercise machine or other commercially available isokinetic dynamometers, are suitable for the purposes at hand.

The appliance 10 will now be described with additional reference to FIGS. 2 through 4. The output force generated by machine 16 is communicated to the appliance 10 via a resistance arm 18. For this, the machine 16 is connected to an enlarged inner end **18*a* of the resistance arm 18 to drive the resistance arm 18, preferably, at a pre-selected angular velocity. The connection is made by conventional means, such as a drive pin 19*a* received within through-hole 19*b* (FIG. 3) in the end 18*a* of the resistance arm 18** for driving engagement therewith.

A generally straight shank portion **18*b* of the resistance arm 18 extends through a top sleeve 20. The top sleeve is slidable along the shank portion 18*b*. The position of the top sleeve 20 along the shank portion 18*b* can be locked by means of a thumb screw 22. As shown, the resistance arm 18 extends generally horizontally forward, with the arm end 18*a* to the rear, and the outer end 18*c* in front, of the top sleeve 20**.

A vertically-oriented, generally straight attachment bar 24 is secured, e.g., welded, end-wise and perpendicularly, to the top sleeve 20. A side sleeve 26 is slidable on the attachment bar 24. The position of the side sleeve 26 along the attachment bar 24 can be locked by means of a thumb screw 28.

The shank portion **18*b* of the resistance arm 18, the attachment bar 24, and the top and side sleeves 20 and 26 are shown as having rectangular cross-sections. The relative positioning of the top and side sleeves 20, 26 on the respective shank portion 18*b* and attachment bar 24** is described more fully below.

A pair of vertically-spaced, generally-parallel fulcrum shafts 30, 32 extend laterally from the side sleeve 26, their ends being secured e.g., welded, to the side sleeve. Hollow cylinders or cylindrical sleeves 36, 38 are mounted concentrically about, for pivotal movement about, the respective fulcrum shafts 30, 32. In other words, upper cylinder 36 receives and can pivot about upper fulcrum shaft 30, and lower cylinder 38 receives and can pivot about lower fulcrum shaft 32. To facilitate the pivotal movement, suitable friction-reducing means, such as a nylon bushing 39 (FIG. 3), can be inserted between the cylinders 36, 38 and the fulcrum shafts 30, 32.

The exercise appliance 10 depicted in FIG. 1, with side sleeve 26 slidably received on the attachment bar 24, is arranged for exercising the right leg of the user. For exercising the left leg of the user, the fulcrum shafts 30,32 are inserted through upper and lower cylinders 36,38 from the opposite ends so that side sleeve 26 is located at the opposite ends of those cylinders as shown in FIGS. 2 to 4. A C-clip, cotter pin or other suitable fastener (not shown) may be provided on the end of at least one fulcrum shaft 30,32 to prevent the shafts from pulling out of their cylinders.

Figure 4:
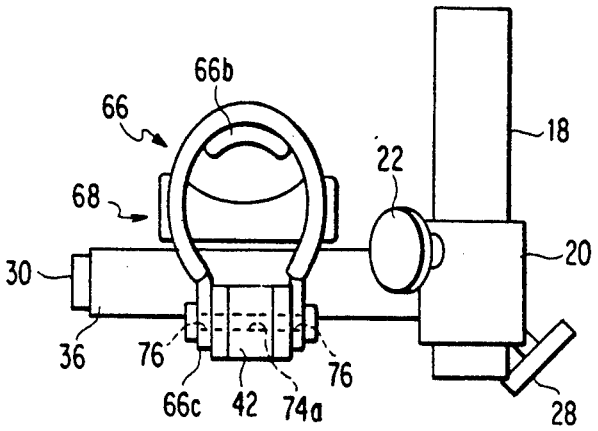
FIG. 4 is a top view of the exercise appliance of FIG. 2.

As best seen in FIGS. 2 and 3, the appliance 10 also has an articulated lever mechanism 40, which includes linked, elongate upper and lower arms 42, 44. The upper arm 42 is secured, e.g., welded, intermediate its length to the upper cylinder 36. Specifically, the upper arm 42 is provided with an arcuate, e.g., semi-circular, relief 46 along its posterior side, as shown best in FIG. 3, which receives therein a portion (e.g., a semi-cylindrical section) of upper cylinder 36. The upper cylinder 36 extends through the relief 46 on both sides in a "cross" configuration, such that the upper arm 42 is positioned, e.g., approximately midway along the length of the upper cylinder 36. Since the lower arm 44 is secured in the same fashion as described above to the lower cylinder 38, it need not be separately described at this point.

The upper and lower arms 42, 44 are coupled at a hinge or yoke 50 for angular motion to and fro in the anterior/posterior direction. To achieve this degree of freedom, the upper end of the lower arm 44 has a longitudinally-directed channel 48 formed between two side walls 52 which receives the lower end of upper arm 42. A vertical slot 53 is present near the lower end of arm 42 and a pivot pin 54 extending between side walls 52 passes through that slot with a clearance fit. With this arrangement, the upper arm 42 is free to pivot about the pivot pin 54 with some longitudinal play. A suitable lubricant and/or bearing means (not shown) can be inserted between the opposing surfaces of the upper arm 42 and the walls of channel 48 to reduce friction during such pivotal motion.

The appliance 10 is attached to and bears against the leg of the user at two spaced locations so as to apply the supportive force in a first direction, and, spaced therefrom, the resistive force in the opposite direction. For this, the appliance 10 has an upper padded strap 66 which applies the supportive force at the top of the calf to the rear of the leg in the anterior direction. Preferably, as shown best in FIGS. 3 and 4, the padded strap 66 includes a flexible belt portion **66*a*, a rear cushion 66*b* and stiffer end portions 66*c* for attachment to the upper arm 42. The appliance 10 also has a lower cushion or pad 68** which applies the resistive force to the extremity of the leg, e.g., at the lower shin.

Both of these, the padded strap 66 and the lower pad 68, are secured pivotally to the articulated lever mechanism 40. Specifically, the padded strap 66 is secured to the upper arm 42 by a pivot pin 72 which extends laterally through a pre-selected one of a plurality of vertically-spaced positioning openings **74*a* to 74*c* (FIG. 3), which are located in the upper arm 42 above the point of attachment of the upper cylinder 36, and through aligned openings 76 (FIG. 4) in the ends of the strap 66 on either lateral side of the upper arm 42. The padded strap 66 can pivot about the pivot pin 72 in the anterior/posterior direction. This arrangement also maintains the padded strap 66** in a looped configuration for encircling the lower leg at the calf.

The lower pad 68 is secured pivotally to the appliance 10 by means of a mounting bracket 78. The mounting bracket 78 includes a mounting stud 80 secured to the rear 81 of the pad 68. The mounting bracket 78 also has a pair of parallel, laterally-spaced, opposing extensions 82 (e.g., plates) which extend in the anterior direction from the mounting stud 80 to which they are pivotally attached by pin 86. The extensions 82 laterally capture the lower arm 44, to which they are bolted by means of a conventional nut 88 and bolt 89. Thus, the lower pad 68 also can pivot in the anterior/posterior direction about a laterally-extending axis defined by the pivot pin 86.

The lower pad 68 is maintained in a selected vertical position by securing the bolt 89 to the lower arm 44 through a pre-selected one of a plurality of vertically-spaced positioning openings **92*a* to 92*c* (FIG. 3), which are located in the lower arm 44 below the point of attachment of the lower cylinder 38, and through openings 94 (FIG. 4) in the extensions 82 of the mounting bracket 78**.

The pivotal arrangements for mounting the upper padded strap 66 and the lower pad 68 assure that each can be worn comfortably and remain flush with the users leg during exercise. If the lower pad 68, for instance, were not allowed to pivot, its top edge would dig into the user's leg as the articulated lever mechanism 40 flexed at the hinge connection of the upper and lower arms 42, 44 during the exercise, as discussed below.

To accommodate different sized calves with a tight fit, the padded strap 66 preferably includes a fastener 90 (e.g., a Velcro ® brand fastener) for manually adjusting its length. In addition, an optional strap 96 having a fastener 90, preferably of the same type, can be used to attach the lower pad 68 directly to the leg.

As mentioned above, the upper and lower arms 42, 44 are attached to the respective upper and lower cylinders 36, 38 intermediate the lengths of the arms. Actually, in a preferred practice of the invention, the particular locations of the upper and lower cylinders 36, 38 are selected to control the magnitude of the forces communicated through the appliance 10 to the patient's leg.

For reasons discussed below, the supportive force at the calf preferably is one and a half times as large as the resistive force at the lower shin. Applying engineering principles of mechanics to the articulated lever mechanism 40 permits the determination of the appropriate placement of the cylinders 36, 38 to achieve this force ratio The upper and lower arms 42, 44 serve as levers acting on fulcrums defined by the fulcrum shafts 30, 32 (and, therefore, the cylinders 36, 38). The effective length of the upper arm 42 is the distance between the articulated lever mechanism pivot pin 54 and the upper padded strap pivot pin 72, while the effective length of the lower arm 44 is the distance between the articulated lever mechanism pivot pin 54 and the bolt 89.

The lower cylinder 38 is placed so as to split the effective length of the lower arm 44 in a ratio which may be varied from 1.0:1 to 1.7:1, with a ratio of 1.5:1 being suitable for a typical man. That is, the distance from the bolt 89 to cylinder 38 is 1.5 as long as the distance from cylinder 38 to the pin 54. Furthermore, the upper cylinder 36 is placed so as to split the upper arm 42 in half. If a force "F" is applied at the bolt 89, a force having a magnitude of $1.5 \times F$ and an opposite direction results at the upper padded strap pivot pin 74.

Because the upper and lower arms 42, 44 are free to pivot about the fulcrum shafts 30, 32, the forces cause a slight anterior displacement of the upper lever arm 42 above the fulcrum shaft 30. Thus, with the appliance 10 spanning an appreciable length of the tibia, the forces communicated through the appliance 10 cause the top of the tibia to be displaced with respect to the bottom of the tibia by a distance that offsets tibial subluxation.

Preferably, this distance is 5 to 15 mm (or approx. a half inch).

In use, the resistance arm 18 of the exercise appliance 10 is connected to the exercise equipment 12. The appliance 10 is placed on the injured leg of a patient who is seated and strapped firmly to the bench 14, as shown in FIG. 1. For exercising the right leg, the side sleeve 26 is positioned as shown in FIG. 1. On the other hand, for exercising the left leg, the side sleeve 26 is located as shown in FIGS. 2 to 4. Preferably, the thumb screw 28 is not tightened until later.

With the patient seated, the approximate center of the injured knee is aligned with the axis of the drive pin, shown at 96 in FIG. 1. Then, the upper padded strap 66 is fastened loosely about the upper calf, and the position of the appliance 10 on the leg is adjusted.

Adjusting the position of the appliance 10 entails the following steps: First, if the padded strap 66 is not positioned near the top of the calf (i.e., along the top third (approx.) of the tibia) when the lower pad is located on the lower shin (along the bottom third (approx.) of the tibia), then the span between the padded strap 66 and the lower pad 68 is adjusted. This is done by moving both the padded strap 66 and the lower pad 68 away from or toward one another, using either an outer pair 74*a*, 92*a*, middle pair 74*b*, 92*b*, or inner pair 74*c*, 92*c* of positioning openings 74, 92.

Thus, three alternative settings for the span of the appliance 10 are provided. These settings, for example, permit the span to be set to over a range of 7.5 inches to 10.5 inches, while maintaining the desired 1.5 ratio of forces. It is believed that this range of sizes provides sufficient flexibility to allow the appliance 10 to fit most people. (Anthropometric data available in most medical libraries indicates that the distance between the knee and the ankle, which corresponds to the length of the tibia, falls in the range of 13.4 to 17.5 inches for a vast majority of people studied. This span, therefore, permits the proper placement of the upper padded strap 66 and lower pad 68 on a wide variety of leg sizes.)

For instance, in FIG. 3, the padded strap 66 is connected to the articulated lever mechanism 40 by inserting the pivot pin 72 through the outer positioning opening 74*a*, and the lower pad 68 is connected by inserting the bolt 89 through the outer positioning opening 92*a* (FIG. 2) to obtain a span there between of 10.5 inches. To fit the appliance 10 on a smaller leg, middle positioning openings 74*b* and 92*b* are used instead to obtain a span of nine inches. For still smaller legs, the inner positioning openings 74*c*, 92*c* are used to obtain a span of 7.5 inches. The reason for moving both connection points is to maintain the same relative positions of the upper padded strap 66 and the lower pad 68 with respect to the fulcrum shafts 30, 32, as described above.

Once the span is correct, the lower pad 68 is secured firmly to the leg by the strap 96, and the side thumb screw 28 is tightened to lock the position of the side sleeve 26 on the attachment bar 24.

Next, the attachment bar 24 is made generally parallel to the tibia. The orientation of the attachment bar 24 is adjusted by loosening the thumb screw 22, moving the top sleeve 20 along the resistance arm 18 to the appropriate location, and then re-tightening the thumb screw 22.

Finally, the upper padded strap 66 is tightened after the upper arm 42 is both pushed as close to the leg as possible, and oriented so as to form an angle of, e.g., approx. 180° with respect to the lower arm 44. For this purpose, the length of the slot 56 in the upper arm 42 preferably is such that the pivot pin 54 received therein reaches the upper end of its travel when the upper and lower arms 42, 44 are approximately linearly aligned.

The appliance 10 now is fully adjusted, and the patient is ready to perform isokinetic extension exercises as instructed by an athletic trainer or physician. During such exercise, the force-generating machine 16 applies an output force to the resistance arm 18 of the exercise appliance 10. This force is transmitted from the resistance arm 18, through the attachment bar 24, the fulcrum shafts 30, 32, and the articulated lever mechanism 40, to the padded strap 66 and the lower pad 68. The padded strap 66 applies a supportive force in the anterior direction onto the rear of the upper calf, while the lower pad 68 applies a resistive force in the posterior direction on the lower shin. The resistive force opposes the extension of the leg by the patient during leg extension exercises, while the combination of these forces urges the tibia towards its normal, unsubluxated orientation with respect to the femur.

Figure 5:
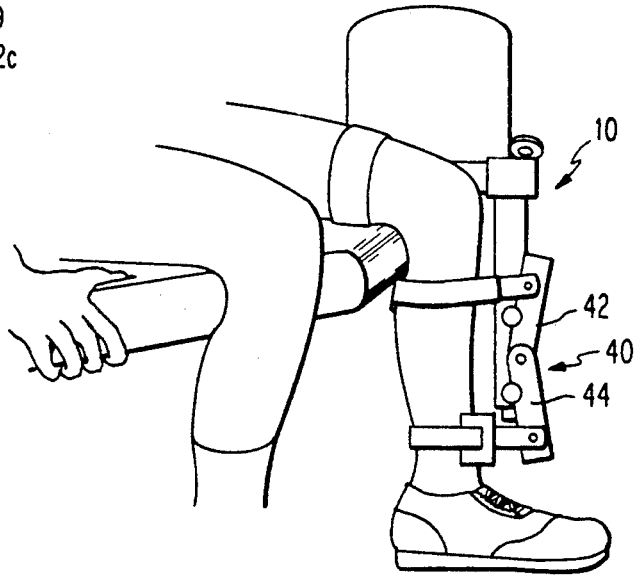
FIG. 5 is a side view of a patient exercising with the exercise appliance of FIG. 2.

FIG. 5 shows a patient exercising with the appliance 10. In this drawing, the patient's leg is at approx. 90° of flexion, and is being extended, i.e., raised, by isometric contraction of the quadriceps muscles. As depicted, the upper and lower arms 42, 44 of the articulated lever mechanism 40 form an obtuse angle less than 180°, with a displacement of the upper lever arm 42 at the top pin 72 equal to the above-mentioned 5 to 15 mm. This displacement is caused by the appliance 10 exerting an anterior pull on the top of the tibia. This shift of the top of the tibia occurs when the user contracts the quadriceps to begin an extension. The appliance 10 not only relocates the tibia, it tends to hold it in the shifted position during the exercise.

Thus, the appliance 10 translates the machine-generated force into the desired supportive and resistive forces, corrects for subluxation of the tibia during the exercise, and permits the rehabilitation of the injured leg while reducing the risk of complications that ca ensue from exercising with a deficient PCL.

b. Anatomy of the Knee and the Role of the Posterior Cruciate Ligament.

To convey a fuller understanding of the features and advantages of the invention, including an analysis of the magnitude of the supportive force required for correcting for tibial subluxation, a brief and selective exposition concerning the anatomy of the knee and the role of the PCL ligament will be presented next.

Figure 7:
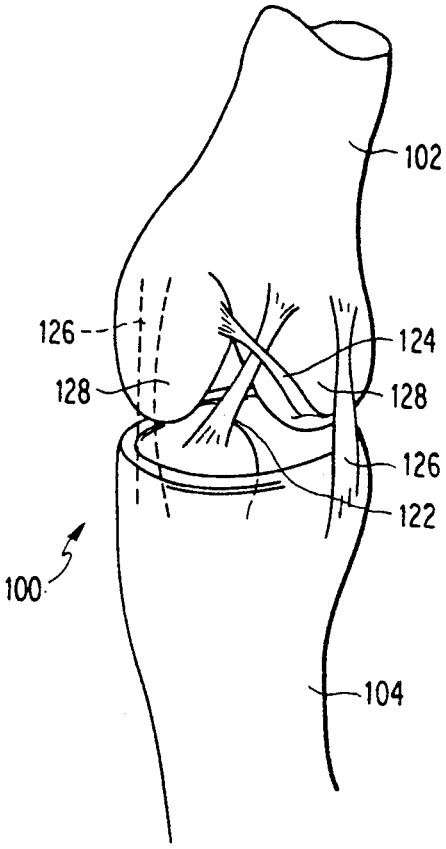
FIGS. 6 and 7 are simplified illustrations of a human knee, respectively showing the quadriceps, femur and tibia, and, in an enlarged view, the chief stabilizing ligaments.
Figure 6:
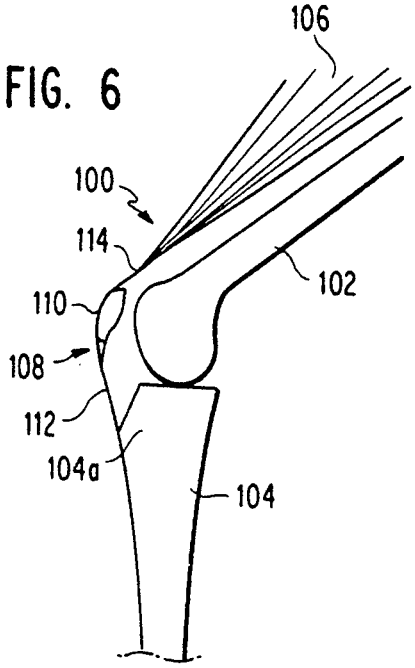

FIGS. 6 and 7 depict a human knee 100, with various anatomical features removed for clarity. The knee 100 is the articulated junction of the femur 102 in the upper leg and the tibia 104 in the lower leg. Also shown are the quadriceps muscles 106, which are the extensors of the knee 100. The quadriceps 106 converge into a common tendon 108 that encloses the patella 110 (knee cap), and connects to the tuberosity 104*a* of the tibia 104. A portion 112 of this tendon 108 located between the patella 110 and the top of the tibia 104 commonly is called the "patellar ligament," while a portion 114 connecting the patella to the quadriceps is called the "quadriceps tendon."

As depicted in FIG. 7, the four ligaments chiefly responsible for stabilizing the knee 100 are the anterior cruciate ligament (ACL) 122, the posterior cruciate ligament (PCL) 124, and two collateral ligaments 126. The cruciate ligaments 122, 124 are located in an internal cavity of the knee 100, crossing each other between the femoral condyles 128, and attaching externally on either side of the knee 100. The cruciate ligaments 122, 124 secure the knee 100 against side-to-side or lateral movement. In other words, they provide stability in an antero-posterior plane called the "sagittal plane."

The cruciate ligaments 122, 124 play an important part in the motion of the knee 100. The PCL 124 extends from the front cavity of the femur 102 down to the rear surface of the tibia 104. The ACL 122 traverses in the opposite direction. Accordingly, engineers will recognize that the cruciate ligaments 122, 124, together with structurally connecting segments on the femur 102 and tibia 104, form a four-bar mechanical linkage in the sagittal plane, said linkage controlling pivoting of the knee in the sagittal plane.

The PCL 124 measures about 3.8 cm in length and 1.3 cm in width (at its widest point) for average young adults. While the longer ACL 122 can only withstand 1,700 newtons of tensile force before failure, the PCL 124 can withstand up to about 2,200 newtons. Because of this, injuries to the PCL 124 are less common than injuries to the ACL 122. Common causes of PCL 124 injuries are athletics (particularly sports like football and skiing which often involve large forces at unnatural angles of impact) and motor vehicle accidents involving impacts between knees and, e.g., the dashboards of an automobiles.

Figure 8:
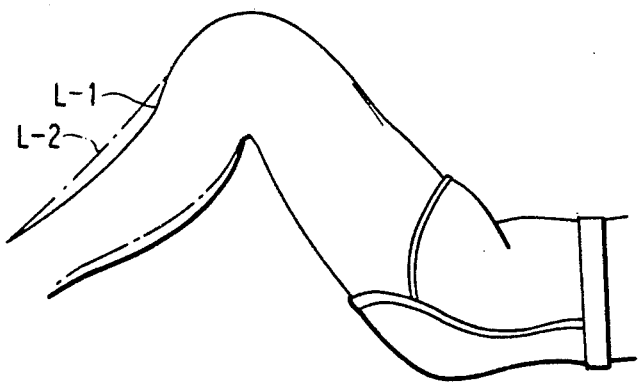
FIG. 8 is an illustration of a leg exhibiting tibial subluxation.

When the PCL 124 is ruptured, anteroposterior stability is reduced. This is evident as excessive posterior-directed sliding of the top of the tibia 104 on the femoral condyles 128 in the sagittal plane. This manifests itself in a posterior sag or subluxation of the tibia 104 from its normal position (e.g., a subluxation of 5 to 15 mm at 90 degrees of flexion, muscles relaxed). FIG. 8 illustrates a patient's leg exhibiting tibial subluxation at L-1, and, in phantom, the leg in a normal, unsubluxated condition at L-2.

Such subluxation of the tibia 104 causes abnormal motion of the knee 100. The subluxation causes the moment arm of the force on the patellar ligament 112 to be reduced, thus increasing the forces across the patella/femur juncture. Thus, a deficient PCL 124 can encumber normal use of the knee 100.

If the knee 100 is exercised unduly before a ruptured PCL 124 is repaired, it has been reported that the knee 100 can suffer degenerative changes, particularly, arthritis in the patello-femoral groove. The patello-femoral groove is the track between the two femoral condyles 128 in which the patella 110 slides during bending of the knee 100. A healthy PCL 124 aids the smooth gliding of the patella 110 in the patello-femoral groove by supporting the tibia 104 between about 65 to 70 degrees and 110 to 120 degrees of flexion of the knee 100 (zero degrees being a straight leg or full extension). Thus, when the PCL 124 is deficient, the tibia 104 lacks support over a sweep of around 50 degrees.

The magnitude of the force required to prevent subluxation and counteract the shear force of the patellar ligament is proportional to the resistive force applied to the lower shin.

Because the supportive force is applied at the calf, it has a shorter moment arm with respect to the center of the knee than does the resistive force applied at the shin. Engineering principles thus require the magnitude of the supportive force to be larger than the magnitude of the resistive force. Calculations based on typical human leg sizes have shown that the supportive force may be typically 1.5 times larger than the resistive force.

To achieve this ratio, and referring to the appliance 10 of FIGS. 1 through 4, the lower arm 44 is positioned on the lower fulcrum shaft 32 such that the fulcrum splits the lower arm 44 in a ratio of 1.5 to 1, that is, the distance between the lower pad connection point, i.e., bolt 89, and the fulcrum shaft 32 is 1.5 times as long as the distance between the lower fulcrum shaft 32 and the articulated lever mechanism pivot pin 54. In addition, the upper arm 42 is positioned on the upper fulcrum shaft 30 such that the length of the upper arm 42 is split in half, that is, the vertical distance between the padded strap connection point, i.e., pivot pin 72, and the upper fulcrum shaft 42 is equal to the distance between the upper fulcrum shaft 42 and the articulated mechanism pivot pin 54.

Since the upper and lower arms 42 and 44 pivot about the articulated lever mechanism pivot pin 54, an anteriorly-directed displacement of the upper arm 42 results along the line of action of $F_c$. This displacement is equal to the tibial subluxation distance, e.g. 5 mm to 15 mm (approximately ½ in.). Thus, this displacement corrects for tibial subluxation during the exercise therapy.

The foregoing description has been limited to a specific embodiment of this invention. It will be apparent, however, that adaptations, variations and modifications can be made to the invention, with the attainment of some or all of the advantages of the invention.

Therefore, it is the object of the appended claims to cover all such adaptations, variations and modifications as come within the true spirit and scope of the invention.

What is claimed is:

1. An apparatus for use in exercise therapy for rehabilitation of a patient's leg having an injured knee, and a tibia which is subluxated in a first, posterior direction proximate said knee, said apparatus comprising:

A) first pivotal means for applying a first, supportive force in a second, anterior direction near a first end of said tibia, said first end being proximate said knee, said second direction being opposite from said first direction;

B) second pivotal means for applying a second, resistive force in said first direction near a second end of said tibia, said second end being distal from said knee; and C) third means pivotally coupling adjacent ends of the first and second pivotal means such that an application of said resistive force tends to rotate said second pivotal means in a first rotational direction, which in turn, via said pivotal coupling means, tends to rotate said first pivotal means in a second, opposite rotational direction to attendantly displace the tibia in a direction to lessen the subluxation.

2. The apparatus in accordance with claim 1, wherein said first force is from 1.0 to 1.7 times larger than said second force.

3. The apparatus in accordance with claim 2, wherein the ratio of said first and second forces is 1.5 to 1.

4. An apparatus for use in rehabilitating an injured joint, said joint comprising a junction of first and second bones, wherein said first bone is subluxated proximate said joint, said apparatus comprising:

A) first pivotal means for applying a first, supportive force in a first direction near a first end of said first bone, said first end being proximate said joint; and B) second pivotal means for applying a second, resistive force in a second direction near a second end of said first bone, said second end being distal from said joint, said second direction being opposite to said first direction; and C) third means pivotally coupling adjacent ends of the first and second pivotal means such that an application of said resistive force tends to rotate said second pivotal means in a first rotational direction, which in turn, via said pivotal coupling means, tends to rotate said first pivotal means in a second, opposite rotational direction to attendantly displace the first bone in a direction to lessen the subluxation.

5. An appliance for use in exercise therapy for rehabilitation of a patient's leg having an injured knee, and a tibia which is subluxated in a first direction proximate said knee, said apparatus comprising:

A) force translating means disposable on the leg of said patient during exercise, and defining three spaced pivot axes in substantially straight alignment; and B) means for applying a force to said force translating means;

C) said force translating means translating said force into a supportive force applied to said tibia proximate said knee in a direction opposite from said first direction, and a resistive force applied near an extremity of said tibia distal from said knee in said first direction such that said tibia is displaced so as to lessen the subluxation.

6. The apparatus in accordance with claim 5, wherein said force translating means comprises:

A) a force transmitting element;

B) means connected to said force transmitting element for applying said supportive force to the calf of the leg; and C) means connected to said force transmitting element for applying said resistive force to the shin of the leg.

7. An appliance for exercising a leg having an injured knee by applying a resistance force to the leg against which the leg can be extended in a first direction while also correcting for a subluxation in a second direction proximate said knee, said appliance comprising:

A) an attachment arrangement connectable to an exercise machine;

B) first and second fulcrum shafts secured to said attachment arrangement;

C) a first cylindrical sleeve mounted about, for pivotal movement about, said first fulcrum shaft;

D) a second cylindrical sleeve mounted about, for pivotal movement about, said second fulcrum shaft;

E) an articulated lever mechanism including i) an upper arm secured to said first cylindrical sleeve for pivotal movement in said first direction, ii) a lower arm secured to said second cylindrical sleeve for pivotal movement in said first direction, iii) said upper and lower arms being coupled proximate adjacent ends thereof for pivotal movement in said first direction;

F) first means connected proximate a second end of said upper arm for applying a force to said leg proximate said knee in said first direction; and G) second means connected proximate a second end of said lower arm for applying a force to said leg distal from said knee.

8. The appliance in accordance with claim 7,

A) wherein the distance between said second means and said second cylindrical sleeve is approximately 1.5 times longer than the distance between said second cylindrical sleeve and said coupling of said upper and lower arms; and B) wherein said first cylindrical sleeve is disposed approximately midway between said first means and said coupling of said upper and lower arms.

9. The appliance in accordance with claim 6 in combination with said exercise machine.

10. A method for use in exercise therapy for rehabilitation of a patient's leg having an injured knee and a tibia which is subluxated in a posterior direction proximate said knee, said method comprising the following steps:

A) displacing the tibia in an the anterior direction proximate the knee, thereby correcting for said tibial subluxation; and B) at the same time as the displacing step is being performed, applying an oppositely directed posterior force to said leg distal from said knee against which said leg is to be extended during the exercise therapy.

11. An apparatus for use in rehabilitating an injured joint, said joint comprising a junction of first and second bones, wherein said first bone is subluxated proximate said joint, said apparatus comprising:

A) an elongate base member (26) adapted to be coupled to an exercise machine, and having a pair of longitudinally spaced pivot shafts (30,32) outstanding from a side thereof, B) first and second articulated levers (42,44) individually pivotally coupled to the pair of shafts with an articulation joint (50) of the levers disposed intermediate the shafts, C) first means (66) coupled to an outer portion of the first lever for applying a first, supportive force in a first direction near a first end of said first bone, said first end being proximate said joint; and D) second means (68) coupled to an outer portion of the second lever for applying a second, resistive force in a second direction near a second end of said first bone, said second end being distal from said joint, said second direction being opposite to said first direction, such that said first bone is displaced so as to lessen the subluxation.

* * * * *